United States Patent [19]

Sawada

[11] 4,175,261

[45] Nov. 20, 1979

[54] DEFLECTION YOKE

[75] Inventor: Eiji Sawada, Tokyo, Japan

[73] Assignee: Denki Onkyo Co., Ltd., Tokyo, Japan

[21] Appl. No.: 865,233

[22] Filed: Dec. 28, 1977

[30] Foreign Application Priority Data

Dec. 28, 1976 [JP] Japan ..... 51-160557

[51] Int. Cl.[2] ..... H01F 7/00

[52] U.S. Cl. ..... 335/210; 335/213

[58] Field of Search ..... 335/210, 213

[56] References Cited

U.S. PATENT DOCUMENTS

| | | | |
|---|---|---|---|
| 3,895,329 | 7/1975 | Logan et al. | 335/213 X |
| 4,023,129 | 5/1977 | Kratz et al. | 335/213 X |
| 4,117,432 | 9/1978 | Shizu | 335/213 X |

FOREIGN PATENT DOCUMENTS

| | | | |
|---|---|---|---|
| 2601205 | 7/1976 | Fed. Rep. of Germany | 335/213 |

*Primary Examiner*—George Harris

*Attorney, Agent, or Firm*—Armstrong, Nikaido, Marmelstein & Kubovcik

[57] ABSTRACT

A deflection yoke includes a coil frame having guide members provided at the front and rear ends of a flared core or coil bobbin. Each guide member has a plurality of circumferentially arrayed finger members spaced so as to define slots having a predetermined width. Each finger member is provided with a pair of projections extending outwardly in the radial direction of the coil frame such that the projections define an annular channel. A troidal-type winding is wound on the coil frame between corresponding ones of the slots, and a saddle-type winding is wound on the coil frame through the annular channel so as to extend along the inside surface of the coil frame.

3 Claims, 4 Drawing Figures

DEFLECTION YOKE

BACKGROUND OF THE INVENTION

This invention relates to a deflection yoke adapted to fit about a cathode ray tube, and more particularly to a deflection yoke having one deflection coil wound in a toroidal configuration and another deflection coil wound in a saddle-like configuration with the use of a coil frame composed of a core or coil bobbin the front and rear ends of which are provided with a guide having a plurality of circumferentially arrayed finger members which define an annular channel and which are spaced so as to define a plurality of slots having a predetermined width.

Deflection yokes adapted to fit about a cathode ray tube are generally constructed by winding the wires of both a horizontal deflection coil and vertical deflection coil about a deflection core in a toroidial-type configuration, or by winding the wires of both coils along the length of the core in a saddle-type configuration, or alternatively by adopting the saddle configuration for the horizontal deflection coil and the toroidal configuration for the vertical deflection coil.

In the case of the saddle-type deflection coil, a wire is wound at high speed between two metal dies so that accurate positioning of the individual turns is difficult. Thus, coils of a planned precision cannot be obtained and coils of uniform quality cannot be mass-produced. On the other hand, in a case where toroidal coils are wound directly on the deflection core, the wire is likely to become displaced at the positions of the initial and final turns and undergo deformation due to the shape of the core; as a result, predictable magnetic field patterns cannot be obtained.

A deflection yoke which combines both the toroidal and saddle-type deflection coils must be sectioned along a plane perpendicular to the axis of the cathod ray tube; thus, each of the coils lacks symmetry in all four quadrants, thereby increasing cross-talk between coils and making accurate beam deflection impossible. A deflection yoke of this type requires auxiliary deflection means. For example, when a deflection yoke of the above-mentioned type is employed in a color television picture tube an electron beam which has passed through a deflecting magnetic field is dispersed. Hence, three electron beams are converged by means of a convergence yoke. However, as is widely known, if a precise magnet field can be obtained from a deflection yoke fitted about a cathrode ray tube in which three electron guns are arranged in a row, the three electron beams can be converged over all positions of the CRT screen merely by using the deflection yoke alone. Since this demands a deflection yoke which can converge three beams with an extremely small error, the generation of the deflecting magnetic field must satisfy strict conditions. Moreover, a suitable configuration for the deflection yoke itself is difficult to attain by conventional techniques.

In an effort to overcome these problems, there is known in the art a deflection coil in which winding guides each having an annular channel are secured to the front end and rear end of a deflection core, with wire conductors being wound through the channels to form the horizontal and vertical deflection coils both of which have a toroidal configuration. However, in deflection yokes of this type a large number of conductor turns cannot be wound on the core, a drawback which reduces deflection efficiency since a high inductance and DC resistance cannot be obtained. Other disadvantages such as a requirement for a large deflection voltage, a substantial rise in the temperature of the deflection yoke and a sizable leakage of magnetic flux render these deflection yokes undesirable.

SUMMARY OF THE INVENTION

Accordingly, it is an object of the present invention to provide a deflection yoke of a construction which affords an extremely accurate deflection coil winding placement and a high deflection efficiency.

It is another object of the present invention to provide a deflection coil of a construction which allows the placement of a deflection coil wire to be optionally changed so as to obtain a predetermined deflection magnetic field.

It is still another object of the present invention to provide a compact deflection yoke in which a toroidal-type winding and a saddle-type winding are wound on a single coil frame.

A further object of the present invention is to provide a deflection yoke which makes it possible to readily construct a deflection coil of uniform deflection characteristics.

Briefly, in accordance with the features of the present invention, a coil frame comprises guides provided at the front and rear ends of a flared core or coil bobbin. Each guide has a plurality of circumferentially arrayed finger members spaced so as to define slots having a predetermined width. Each finger member is provided with a pair of projections extending outwardly in the radial direction of the coil frame such that the projections define an annular channel. A first deflection coil, for example a horizontal deflection coil, is wound on the coil frame in a toroidal configuration between corresponding ones of slots defined between the finger members of the guides, and a second deflection coil, for example a vertical deflection coil, is wound on the coil frame in a saddle-type configuration through the annular channel on the finger members of each guide so as to extend along the inside surface of the coil frame.

DETAILED DESCRIPTION OF THE INVENTION

Figure 1:
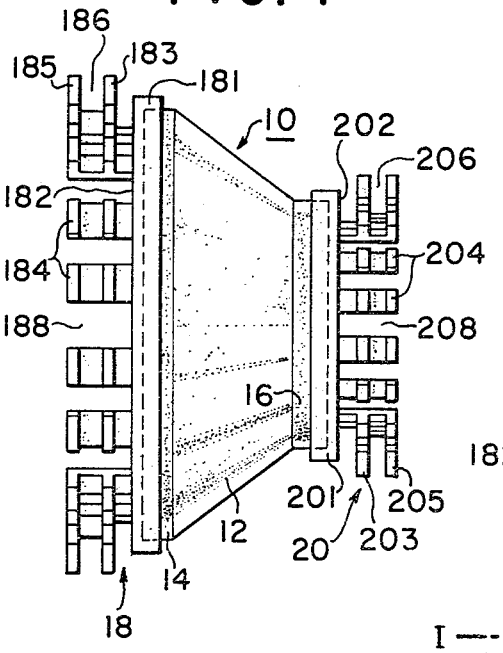
FIG. 1 is a side view of a coil frame employed in a preferred embodiment of a deflection yoke according to the present invention.

Referring now to FIG. 1, a coil frame 10 comprises ring-shaped guides 18, 20 which are attached to the front end (screen side) 14 and rear end (electron gun side) 16 of a flared deflection core body 12 made of ferrite. The guides 18, 20 are fabricated from an insulating material such as polycarbonate or polyphenylene and are provided with annular attachment portions 182, 202 and with a plurality of circumferentially arranged finger members 184, 204 extending from respective attachment portions 182, 202 and spaced so as to define slots 188, 208 of a predetermined width. The attachment portions 182, 202 include collars 181, 201 which are fitted over the outer rim of the core body 12 at its front and rear ends 14, 16 so as to secure the attachment portions to the core body. Alternatively, a bonding agent such as epoxy resin may be employed when necessary to assure a firm connection. Each finger member 184, 204 is formed to include at its end a pair of projections 183, 185, and 203, 205 extending outwardly in the radial direction of the core. Pairs of projections 183, 185 and 203, 205 formed on each of the arrays of finger members 184, 204 define circumferentially extending annular channels 186, 206 spaced a given distance from the attachment portions 182, 202.

Figure 2:
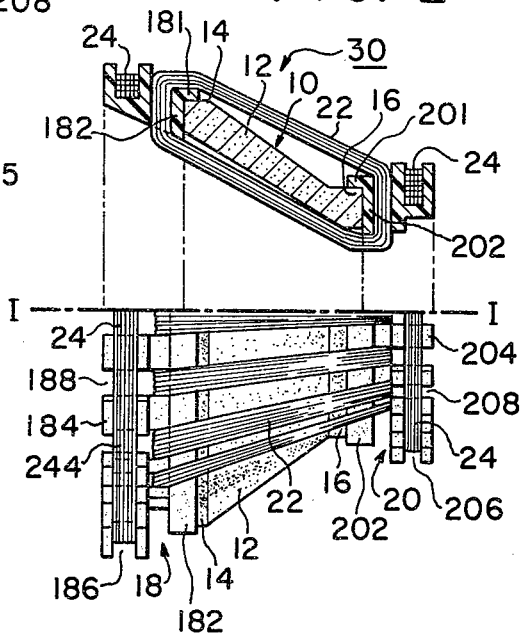
FIG. 2 is a side view of a deflection yoke employing the coil frame of FIG. 1 and wound with a wire, the portion above the line I—I being shown in cross-section.
Figure 3:
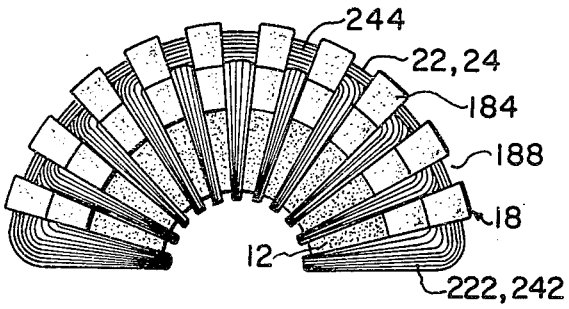
FIG. 3 is a front view of one-half the deflection yoke illustrated in FIG. 2.

FIGS. 2 and 3 show a deflection yoke 30 in which the coil frame 10 is wound with a vertical deflection coil 22 and horizontal deflection coil 24. The vertical deflection coil 22 is constructed by stretching wires between corresponding ones of slots 188, 208 defined between the finger members 184, 204 of the guides 18, 20, thereby forming a longitudinal portion 222 of toroidal construction. On the other hand, the horizontal deflection coil 24 is constructed by passing wires through the slots 188, 208 so as to form a longitudinal portion 242 along the inside surface of the coil frame 10, and by passing the wires through the annular channels 186, 206 of the arrayed finger members 184, 204, thereby forming a transverse portion 244 of saddle-type configuration.

More specifically, the vertical deflection coil 22 is formed first by winding wires on the coil frame 10 using the slots 188, 208 in order to form a coil of toroidal configuration. In this case, a part of the longitudinal portion 222 of the vertical deflection coil 22 can be disposed so as to intersect a plane passing through the axis of the CRT by suitably selecting slots 188, 208. Next, the horizontal deflection coil 24 is formed by winding wires in a saddle-type configuration using the annular channels 186, 206 of the guides 18, 20 and the slots 188, 208. As can be seen in FIG. 3, the longitudinal portion 242 of the horizontal deflection coil 24 is disposed along the inside surface of the body 12 of coil frame 10 so as to overlap the longitudinal portion 222 of the vertical deflection coil 22.

Figure 4:
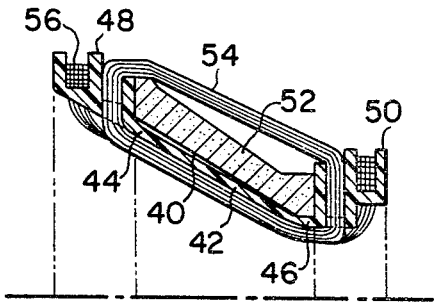
FIG. 4 is a sectional side view of one-half another embodiment of a deflection yoke according to the present invention.

Another preferred embodiment of a deflection yoke according to the present invention is illustrated in FIG. 4 in which the coil frame 40 has a unitary construction with guides 48, 50 formed on the front and rear ends 44, 46 of a coil bobbin body 42. In this case, a deflection core 52 is disposed about the outer peripheral surface of the coil bobbin body 42, a vertical deflection coil 54 and horizontal deflection coil 56 being wound on the coil bobbin body without lying in direct contact with the deflection core 52. According to this structure, the coil frame 40 can be constructed without being influenced by the dimensional requisites of the core 52.

Other embodiments are possible in which the horizontal deflection coil 24 can be lengthened with respect to the vertical deflection coil 22 by projecting further, in a direction parallel to the axis of the CRT, the position of the annular channels 186, 206 of the finger members 184, 204. Alternatively, it is possible to lengthen the horizontal deflection coil only at the forward or screen side of the deflection yoke if only the position of the annular channel 186 of guide 18 is projected toward the screen side. The same effect can also be obtained at only the rear end of the yoke.

It is also possible in the present invention to eliminate the projections 183, 203 and construct the annular channels 186, 206 of the finger members 184, 204 provided on the guides 18, 20 by suitably shaping the appropriate portions of finger members that initially possess a flat, plate-like shape.

While the present invention has been shown and described with reference to particular embodiments by way of example only, it should be noted that various other changes or modifications may be made without departing from the scope of the present invention.

What is claimed is:

1. A deflection yoke comprising:

a coil frame including a flared body and first and second guide members provided at the front and rear ends of the flared body, each guide member including a ring-shaped attachment portion and a plurality of pairs of circumferentially arrayed finger members displaced from said attachment portion and extending radially with respect to said attachment portion and circumferentially spaced from one another wherein slots are formed between adjacent pairs of said finger members and grooves are formed by the finger members of each pair, all of said grooves being aligned to form a circumferential annular groove;

a toroidal-type deflection coil wound on said coil frame in a toroidal configuration between corresponding ones of said slots formed between the finger members of said guide members; and a saddle-type deflection coil wound on said coil frame in a saddle-type configuration in the annular circumferential grooves formed by said finger members.

2. A deflection coil according to claim 1, wherein said flared body comprises a deflection core.

3. A deflection coil according to claim 1, wherein said flared body comprises a coil bobbin formed integral with said guide members.

* * * * *